US010336582B2

(12) United States Patent
Gartner et al.

(10) Patent No.: US 10,336,582 B2
(45) Date of Patent: Jul. 2, 2019

(54) PASSENGER TRANSPORT SYSTEM WITH MONITORING AND MARKING DEVICE FOR CHARACTERIZING DEFECTIVE STEP UNITS

(71) Applicant: INVENTIO AG, Hergiswil (CH)

(72) Inventors: Manfred Gartner, Felixdorf (AT); Thomas Novacek, Schwechat (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 16/312,165

(22) PCT Filed: Jun. 21, 2017

(86) PCT No.: PCT/EP2017/065222
§ 371 (c)(1),
(2) Date: Dec. 20, 2018

(87) PCT Pub. No.: WO2017/220648
PCT Pub. Date: Dec. 28, 2017

(65) Prior Publication Data

US 2019/0161324 A1 May 30, 2019

(30) Foreign Application Priority Data

Jun. 21, 2016 (EP) ..... 16175487

(51) Int. Cl.
*B66B 23/12* (2006.01)
*B66B 23/14* (2006.01)
(Continued)

(52) U.S. Cl.
CPC ..... *B66B 25/006* (2013.01); *B66B 23/12* (2013.01); *B66B 23/14* (2013.01); *B66B 29/005* (2013.01); *B66B 29/06* (2013.01)

(58) Field of Classification Search
CPC ..... B66B 23/12; B66B 23/14; B66B 29/06; B66B 25/006; B66B 29/005
(Continued)

(56) References Cited

U.S. PATENT DOCUMENTS 4,638,901 A * 1/1987 Lunardi ..... B66B 23/12 198/323
4,756,398 A * 7/1988 Watanabe ..... B66B 23/12 198/324
(Continued)

FOREIGN PATENT DOCUMENTS

EP 0924157 6/1999
JP 2001002358 A 1/2001
(Continued)

OTHER PUBLICATIONS

US 2003/0168311 A1, Balzer-Apke et al., Sep. 11 (Year: 2003).*
(Continued)

*Primary Examiner* — Douglas A Hess
(74) *Attorney, Agent, or Firm* — Knobbe Martens Olson & Bear LLP

(57) ABSTRACT

The application relates to passenger transport systems and related methods. The passenger transport system has multiple step units, a comb plate, a monitoring device, and a marking device. The step units are to be moved one behind the other continuously along a predefined movement path during normal operation. The comb plate is arranged at a fixed position relative to the predefined movement path. The monitoring device is configured to monitor an actual position of a currently monitored step unit relative to the predefined movement path and to detect a deviation of the actual position from the predefined movement path by more than an allowable tolerance value and activate the marking device in response thereto. Upon being activated, the marking device is configured to mark the currently monitored
(Continued)

step unit and/or a step unit spatially correlating to the currently monitored step unit.

17 Claims, 3 Drawing Sheets

(51) Int. Cl.
*B66B 29/06* (2006.01)
*B66B 25/00* (2006.01)
*B66B 29/00* (2006.01)

(58) Field of Classification Search
USPC ..... 198/322, 323, 502.3
See application file for complete search history.

(56) References Cited

U.S. PATENT DOCUMENTS 4,805,757 A * 2/1989 Wilcox ..... B66B 29/02 198/333
4,863,006 A * 9/1989 Kotkata ..... B66B 29/005 198/323
5,785,165 A * 7/1998 Stahlhut ..... B66B 25/00 198/322
6,049,189 A * 4/2000 Markus ..... B66B 25/00 198/322
6,601,688 B1 * 8/2003 Stoxen ..... B66B 29/005 198/322
7,407,048 B2 * 8/2008 Boom ..... B66B 25/00 198/323
8,839,942 B2 * 9/2014 Tautz ..... B66B 29/005 198/323
8,950,568 B2 * 2/2015 Casielles Estrada ..... B66B 23/147 198/324
8,960,407 B2 * 2/2015 Braasch ..... B66B 25/003 198/323
8,997,968 B2 * 4/2015 Braasch ..... B66B 25/006 198/322
9,695,016 B2 * 7/2017 Sonnenmoser ..... B66B 5/0037
9,850,100 B2 * 12/2017 Blondiau ..... B66B 25/00
10,183,843 B2 * 1/2019 Hu ..... B66B 21/02

FOREIGN PATENT DOCUMENTS

JP 2008222357 A 9/2008
JP 2016098114 A 5/2016
KR 920007689 Y1 10/1992
WO WO2007144954 A1 12/2007
WO WO200832352 A1 3/2008
WO WO2009047146 A1 4/2009

OTHER PUBLICATIONS

US 2006/0006045 A1, Stripling et al., Jan. 12 (Year: 2006).*
International Search Report for International Application No. PCT/EP2017/065222 dated Jul. 25, 2017.

* cited by examiner

PASSENGER TRANSPORT SYSTEM WITH MONITORING AND MARKING DEVICE FOR CHARACTERIZING DEFECTIVE STEP UNITS

TECHNICAL FIELD

The present invention relates to a passenger transport system such as an escalator or a moving walkway.

SUMMARY

Passenger transport systems are used to transport passengers between different levels or within a constant level, for example in buildings. For example, escalators, which are occasionally also referred to as moving stairs, are used to transport passengers in a building, for example, from one floor to another floor. Moving walkways can be used to transport passengers within a floor in a horizontal plane or merely a slightly inclined plane.

Passenger transport systems usually have multiple step units on which, for example, passengers can stand and can be transported by the passenger transport system. In the case of escalators, the step units are also referred to as steps. In the case of moving walkways, the step units are typically referred to as pallets. The step units usually comprise metal and can be produced as cast parts, for example. A surface of a step unit that faces upwards is usually profiled with longitudinal ribs that extend in the direction of travel and longitudinal grooves therebetween. The step units are generally arranged so as to be mutually parallel and one behind the other. In this case, the step units are interconnected at regular intervals with of a conveyor mechanism, such as a conveyor chain, and can be moved one behind the other continuously along a predefined movement path by means of the conveyor means, for example, during normal operation of the passenger transport system The predefined movement path can be predetermined by a guide or a rail, for example, along which the step units are moved, usually in a rolling or sliding manner on guide roll elements or guide slide elements.

Comb plates are usually provided on the passenger transport system near the ends of the movement path. In this case, the comb plates are arranged at a fixed position relative to the movement path and therefore relative to the step units moving along the movement path. In this case, the comb plates are provided at the transition between the step units moving along the movement path and a stationary structure of the passenger transport system. In this case, teeth of the comb plate mesh with the longitudinal grooves between the longitudinal ribs of the step unit. When the passenger transport system is in normal operation, the step units move one after the other usually just below the comb plates. A gap between an upper face of each step unit and a lower face or the teeth of the comb plate should be as small as possible in this case, e.g. smaller than 2 mm, such that it is impossible for objects or body parts to fall between the comb plate and the step unit and get caught in the gap, for example.

Examples of passenger transport systems and of details of the components thereof are specified in WO 2009047146 A1 and in EP 0 924 157 B1.

It has been observed that in some instances, there can be collisions between the moving step units and the stationary step units. For example, wear on the guide roll elements or guide slide elements of individual step units can have the result that said step units are no longer guided exactly along the predefined movement path when they are displaced. A slight deviation from the predefined movement path can, in particular where a step unit is to be guided below a comb plate, have the result that the step unit is no longer sufficiently spaced apart from the comb plate via a gap, but instead can directly rub against said comb plate or, at worst, the front face of said step unit collides with the comb plate. This can occur in particular if the step unit can tip, for example due to backlash, about a horizontal axis and is then, just before passing below the comb plate, subjected to load by a passenger, for example, such that the front edge of said unit pushes upwards and then collides with the comb plate.

Collisions between step units and comb plates may lead to damage to the passenger transport system. Usually, operation of the passenger transport system must be interrupted and the passenger transport system must be serviced, which may lead to long periods of downtime. During maintenance, the step unit causing the collision must be identified in order to be able to put the passenger transport system back into operation by repairing or replacing worn or damaged components.

There may be, inter alia, a desire for a passenger transport system in which the risk of damage to the passenger transport system due to collisions between a step unit and a comb plate is reduced and/or periods of downtime of the passenger transport system caused by collisions of this kind can be prevented or at least shortened.

A desire of this kind can be met by a passenger transport system as described below. A desire of this kind can also be met by a method for modernizing an existing passenger transport system as described below. Advantageous embodiments are defined throughout this application.

According to a first aspect of the disclosure, a passenger transport system is proposed which comprises multiple step units, a comb plate, a monitoring device and a marking device. The step units are to be moved one behind the other continuously along a predefined movement path during normal operation. The comb plate is arranged at a fixed position relative to the predefined movement path. The monitoring device is designed to monitor an actual position of a currently monitored step unit relative to the predefined movement path and to detect a deviation of the actual position from the predefined movement path by more than an allowable tolerance value and activate the marking device in response thereto. Upon being activated, the marking device is designed to provide the currently monitored step unit and/or a step unit spatially correlating to the currently monitored step unit in a defined manner with a marking.

Optionally, the marking device may also be designed to identify a unique marking that is already present on the step unit.

According to a second aspect of the disclosure, a method for modernizing an existing passenger transport system is proposed. In this case, the passenger transport system comprises multiple step units and a comb plate. The step units are to be moved one behind the other continuously along a predefined movement path during normal operation. The comb plate is arranged at a fixed position relative to the movement path. The method comprises retrofitting the passenger transport system with a monitoring device and a marking device. In this case, the monitoring device is designed to monitor an actual position of a currently monitored step unit relative to the predefined movement path and to detect a deviation of the actual position from the predefined movement path by more than an allowable tolerance value and activate the marking device in response thereto. Upon being activated, the marking device is designed to provide the currently monitored step unit and/or a step unit spatially correlating to the currently monitored step unit in a defined manner with a marking.

Possible features and advantages of embodiments of the present disclosure may be considered, among others and without limiting the invention, to be based on the findings described below.

As noted in the introduction, in the case of passenger transport systems, there is a risk of collisions between moving step units and stationary comb plates. In order to minimize this risk as far as possible or at least to be able to keep the cost of repairing or servicing the passenger transport system caused by a collision to a minimum, it is proposed to provide the passenger transport system with a specific monitoring device. In this case, the monitoring device is designed to identify step units that are so defective or worn that they no longer move exactly along the predefined movement path of the passenger transport system.

For this purpose, the monitoring device monitors an actual position or actual movement path of each step unit during an individual period for each step unit or whilst said step unit moves along a specific portion of the movement path. In this case, the monitoring device can detect whether the actual position of a currently monitored step unit is on the predefined movement path or whether the actual movement path corresponds with the predefined movement path or whether there are considerable deviations between the predefined movement path and the actual movement path.

If there are deviations that exceed a predetermined tolerance value, this can be detected by the monitoring device and be taken as evidence that the currently monitored step unit is no longer guided sufficiently exactly along the predefined movement path, but instead may deviate dangerously far therefrom, such that there is danger of a collision with the comb plate. On the basis of this information detected by the monitoring unit, suitable measures can be taken. For example, as a result the passenger transport system may completely cease or at least modify its operation, until suitable maintenance or repair of the step unit in danger of collision can take place.

However, it has often proven to be expensive in practice for maintenance or repair personnel to reliably identify the step unit in danger of collision. Optionally, all of the step units had to be extensively checked in order to identify whether one or more step units, for example, could deviate from the predefined movement path due to wear.

It is therefore proposed to also provide a marking device for the passenger transport system. Using this marking device, markings can be applied to one or more step units and/or existing unique markings can be identified. These markings can then be detected by maintenance or repair personnel.

The monitoring device and the marking device then interact such that the monitoring device activates the marking device as soon as it detects that a currently monitored step unit deviates from the predefined movement path by more than an allowable tolerance value, as a result of which the marking device suitably provides the currently monitored step unit with a marking or identifies said step unit.

Alternatively or additionally, the marking device may not mark the currently monitored step unit or may mark not only said step unit, but also a step unit spatially correlating to said step unit in a defined manner. For example, instead of or in addition to the currently monitored step unit, the subsequent one, two or more step units can be marked by the marking device.

On the basis of the applied markings, maintenance or repair personnel can very easily and reliably detect which of the step units has been identified by the monitoring device as potentially in danger of collision, and can then service, repair or exchange said step unit without searching for a long time.

According to one embodiment, the marking device is designed to form the marking as a visually perceptible marking. A "visually perceptible marking" is understood to mean a marking that can be seen by service personnel with the naked eye. This can have the advantage that a marked step unit can be identified without additional aids. i.e. in particular without tools, and therefore very simply.

In principle, it is also conceivable to design the marking such that it is not visually perceptible. For example, markings could be applied to a step unit that are not visible to the naked eye, but instead can be seen only by means of suitable tools, for example. E.g. a marking could be visible only under UV light from a UV lamp.

According to one embodiment, the marking device is designed to apply the marking to the step unit contactlessly. In this case, "contactlessly" can be understood to mean that the marking device does not touch the step unit during marking. Accordingly, there is no friction and therefore no wear during marking. Furthermore, it is preferably not necessary to adjust the marking device relative to the movement path of the step units accurately, in particular accurately to within a few millimeters, as would be the case, for example, if the marking device were to mark the step units in a contact-based manner.

According to one embodiment, the passenger transport system comprises a paint spray device. In this case, a paint spray device is a device by which paint can be sprayed onto the step unit to be marked. The paint spray device does not need to touch the step unit and needs to be adjusted only roughly with regard to its position and/or orientation. Any desired substances can be used as the paint to be sprayed, as long as they reliably adhere to the step unit to be marked and are preferably also visually perceptible.

Alternatively, paint may be applied using a different type of marking device. For example, the activated marking device may bring a type of pen close to the step unit to be marked. Colored adhesive strips could also be pressed onto the step unit to be marked.

According to one embodiment, the marking device is designed and arranged to provide the step unit with the marking on a lower face and/or a lateral flank thereof. In this case, the lower face of the step unit is opposite a step surface of the step unit on the upper side thereof, on which step surface the user of the passenger transport system can stand. The lateral flanks extend between the lower face and the step surface of the step unit. Both the lower side and the lateral flanks of the step unit are typically not visible to a user of the passenger transport system, such that markings applied thereon cannot be seen by said user and therefore cannot irritate or disturb him. However, the markings can be easily identified by service personnel as part of a maintenance or repair procedure. Additionally, a marking device provided for marking from below or from the side can be installed below the movement path of the step units or, for example, in a side panel.

Optionally, the individual step units already comprise a clearly distinguishable marking due to the production process. A marking of this kind may be a serial production number, a barcode, an integrated RFID tag or the like, for example. According to one embodiment, the marking device may be designed to detect and identify an existing marking that can be uniquely assigned to each step unit. For this purpose, the marking device must be a detection device such as a camera, an RFID reading device and the like.

According to one embodiment, the monitoring device comprises a mechanically actuated position detector, which is designed and arranged to be mechanically actuated if there is a deviation of the actual position of the currently monitored step unit from the predefined movement path by more than an allowable tolerance value.

In other words, a position detector in the form of a button, sensing device, switch or other type of mechanical sensor, for example, can be provided for the monitoring device. The position sensor may be arranged inside the passenger transport system such that said sensor is actuated only when the currently monitored step unit deviates excessively from its predefined movement path.

"Actuating the position detector" can be interpreted broadly in this case as a detectable change in state of the position sensor. In other words, a button forming the position sensor cannot be depressed when not actuated and can be actuated by being depressed. Conversely, however, a button can be depressed when not actuated, too, and can be actuated by being released. In other words, the position detector may be of the "normally open" kind or of the "normally closed" kind.

According to one embodiment, the passenger transport system comprises a conveyor chain. In this case, each step unit is, at a defined position, mechanically connected to the conveyor chain and to be moved by means of the conveyor chain. The monitoring device is then designed to indirectly monitor the position of the currently monitored step unit by monitoring a current position of the conveyor chain.

In other words, all of the step units are attached at their respective positions to a common conveyor chain, in order to be able to move the step units together along the movement path. Instead of detecting the position of an individual step unit directly at this step unit, said position may be detected indirectly, by the current position of the conveyor chain being monitored. As the position of the conveyor chain directly correlates with the position of a step unit attached to said conveyor chain, the exact position of the step unit in question can therefore be detected. Optionally, it may be easier to determine the position of the conveyor chain than to directly detect the position of the relevant step unit.

For example, a position sensor in the form of a button may be arranged such that the conveyor chain either continuously depresses the button in normal operation or is guided past the button at a close distance, such that a deviation of the conveyor chain from its normal movement path and, by association, a deviation of the step unit attached to said conveyor chain from the predefined movement path leads to mechanical actuation of the position sensor.

According to one embodiment, the monitoring device is designed to monitor the actual position of the currently monitored step unit contactlessly.

In other words, it may be advantageous to monitor the actual position of the currently monitored step unit on the basis of contactlessly measurable parameters, which depend on the position of the step unit. For example, optical, magnetic, capacitive, inductive or similar parameters can be monitored. In the case of contactless monitoring of the position of the step unit, friction and accompanying wear can be prevented. Additionally, a detector or sensor used for monitoring can be adjusted with regard to its position usually more inaccurately than is typically the case in monitoring methods based on mechanical actuation, for example.

In particular, according to one embodiment, the monitoring device may be designed to monitor the actual position of the currently monitored step unit optically. The position of the step unit can be detected easily, contactlessly and usually very precisely using an optically operating position detector.

For example, according to one embodiment, the monitoring device may comprise an optically operating position detector, which is designed and arranged to be actuated if there is a deviation of the actual position of the currently monitored step unit from the predefined movement path by more than an allowable tolerance value. An optically operating position detector of this kind may be designed in the form of a single-stage or multi-stage light barrier, for example. The position detector may be arranged, depending on the design of the passenger transport system and/or of the monitoring device, at various locations, and/or may monitor various regions of a step unit to be currently monitored or components connected thereto, with regard to the current position thereof.

For example, according to one embodiment, the monitoring device may be designed and arranged to monitor a position of a step surface of the currently monitored step unit that faces upwards.

The monitoring device may comprise a position detector for this purpose, which detector is arranged laterally next to the step units guided past said detector, for example. For example, the position detector may be arranged on or in a lateral balustrade of the passenger transport system and, from there, can monitor the position of the step surfaces of the step units guided past said detector.

According to one embodiment, the passenger transport system may further comprise a guide device, which is designed and arranged to guide the step units at a sufficient spacing from the comb plate whilst they are being moved.

In other words, a guide device may be provided in addition to the above-described components of the passenger transport system, which guide device guides the step units during operation of the passenger transport system specifically such that a collision between a step unit and a comb plate is prevented and, instead, the step unit is consistently guided past the comb plate at a sufficient spacing therefrom.

In this case, the monitoring device can also reliably detect when a step unit moves excessively away from its predefined movement path, for example due to wear, and can then initiate service or repairs, for example. However, even without immediate service or repair, a collision between the step unit and the comb plate does not occur promptly, due to suitable guidance by the guide device. However, the necessary service or repair should be carried out nevertheless, for example in order to be able to minimize further wear to the step unit and/or to other components of the passenger transport system, such as the guide unit in particular.

It can also be provided that the guide device does not permanently guide the step units. Instead, the guide device may be activated only when a danger of collision between a step unit and the comb plate is actually detected. i.e. when an activation signal is generated by the monitoring device, for example. This can minimize wear to the guide device, for example.

According to one embodiment, the monitoring device is further designed to cause the passenger transport system to cease its normal operation and/or to transmit a warning signal.

In other words, the activation of the marking device initiated by the monitoring device should preferably not lead merely to the currently monitored step unit being marked.

Instead, it may be provided that the passenger transport system implements an activation signal transmitted from the monitoring device such that said system ceases its normal operation. This may mean that operation of the passenger transport system is completely stopped or the passenger transport system transitions into a type of special operation in which the step units are moved more slowly and/or in which a guide device is activated, for example. Alternatively or additionally, a warning signal may be generated as a result of the activation signal transmitted from the monitoring device. A warning signal of this kind may be perceptible to users of the passenger transport system, for example, and may be transmitted in particular optically or acoustically. Alternatively, a warning signal may be transmitted to a central monitoring office or maintenance center, for example as an electrical signal, in order to signal to said monitoring office or center that the passenger transport system should be serviced or repaired promptly.

According to one embodiment, the tolerance value is selected such that a spacing between a surface of a profile of the comb plate that faces downwards and a surface of the currently monitored step unit that is opposite said surface and faces upwards is larger than 0.3 mm, preferably larger than 0.7 mm, and smaller than 3 mm, preferably smaller than 2 mm and more preferably smaller than 1.6 mm.

During normal operation, i.e., as long as the step units are moved along the predefined movement path, such a spacing, i.e., a gap between the upper face of the step units guided below the comb plate and the lower face of the comb plate, should be uniformly between 1 and 2 mm, for example approximately 1.5 mm. If there are wear-related deviations from the predefined movement path, this spacing may decrease, however.

The tolerance value to be taken into account by the monitoring device should be selected such that the above-mentioned spacing decreases preferably to no less than 0.7 mm, although at least to no less than 0.3 mm. In other words, the monitoring device should monitor the actual position of the currently monitored step unit relative to a predefined movement path and assume a tolerance value not to be exceeded such that the surface of the step unit that faces upwards does not come any closer to the surface of the profile of the comb plate that faces downwards than 0.3 mm, preferably no closer than 0.7 mm, and should activate the marking device when the tolerance value is exceeded.

The way in which the tolerance value is to be dimensioned in the specific usage case may depend heavily on the actual implementation of the monitoring unit. For example, the tolerance value may be selected so as to be different depending on whether the position of the currently monitored step unit is measured directly at the step unit or indirectly at the components connected to said step.

It should be noted that some of the possible features and advantages of the disclosure are described herein in part with reference to a passenger transport system and in part with reference to a method for modernizing a passenger transport system. A person skilled in the art recognizes that the features can be combined, transferred, adapted or replaced as appropriate in order to arrive at further embodiments of the invention.

BRIEF DESCRIPTION OF THE DRAWINGS

Embodiments of the invention will be described below with reference to the accompanying drawings. Neither the drawings nor the description being intended to be interpreted as limiting the invention.

The drawings are merely schematic and not to scale. Like reference signs refer to like or analogous features in the different drawings.

DETAILED DESCRIPTION

Figure 1:
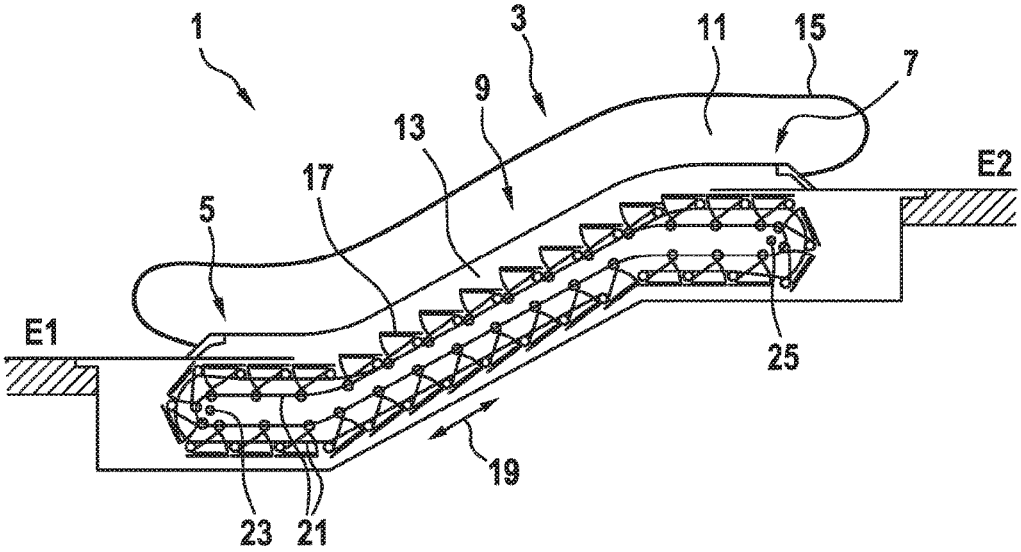
FIG. 1 is a sectional view of a passenger transport system in the form of an escalator.

FIG. 1 shows a passenger transport system 1 designed as an escalator 3. The escalator 3 is used to convey passengers between levels E1 and E2. The escalator 3 comprises a lower access region 5 and an upper access region 7. A region 9 that is inclined to the horizontal runs between the lower and upper access regions 5, 7, which both extend horizontally. The escalator 3 comprises lateral balustrades 11 and skirting panels 13. Endless handrails 15 are provided along each balustrade 11.

In order to be able to convey passengers while standing, the passenger transport system 1 comprises a plurality of step units 17, which are designed as steps in the case of the escalator 3. The step units 17 are arranged one behind the other, with respect to a direction of travel 19 of the escalator 3, and adjoin one another substantially directly. In this case, the step units 17 are each connected to a conveyor chain 21 (sometimes also referred to as a step chain), using which the step units 17 can be moved in the direction of travel 19 along a movement path. During normal operation, the step units 17 are guided along a predefined movement path by means of guide rollers or guide slide elements, for example, which are guided by rails or similar guide elements. The conveyor chain 21 and the step units 17 fastened thereto are deflected close to the two access regions 5, 7 by an upper deflecting unit 25 and a lower deflecting unit 23.

Figure 2:
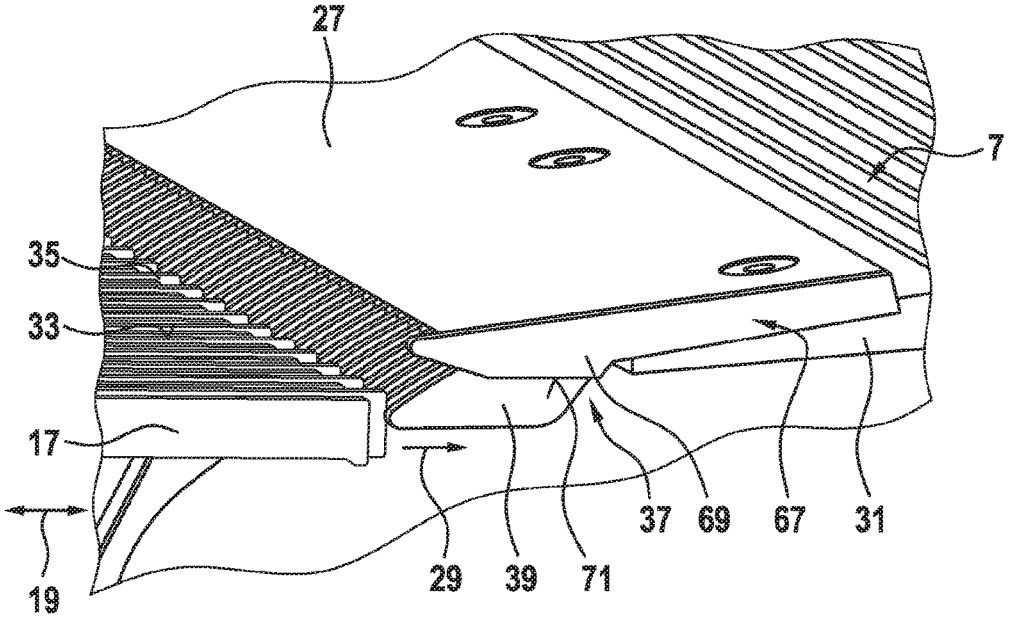
FIG. 2 is a perspective view of an end region of an escalator adjoining a comb plate.

At the two access regions 5, 7, the step units 17 moved by the conveyor chain 21 each pass through below a comb plate 27. FIG. 2 is an enlarged perspective view of this region. Whereas the step units 17 move along the predefined movement path 29, the comb plate 27 is fixed so as to be stationary, for example on a comb plate receiver 31 in the access region 7, and is therefore at a fixed position relative to the predefined movement path.

In the example shown, a surface 33 of the step unit 17 that faces upwards has ribs 35 and grooves located therebetween, which grooves are each oriented in parallel with the direction of travel 19. A plurality of teeth 39 are located on the comb plate 27 on a surface 37 thereof that faces downwards and therefore towards the step unit 17 passing therebelow, which teeth mesh with the grooves of the step unit 17. Optionally, the comb plate 27 may be composed of multiple adjacent segments.

Figure 3:
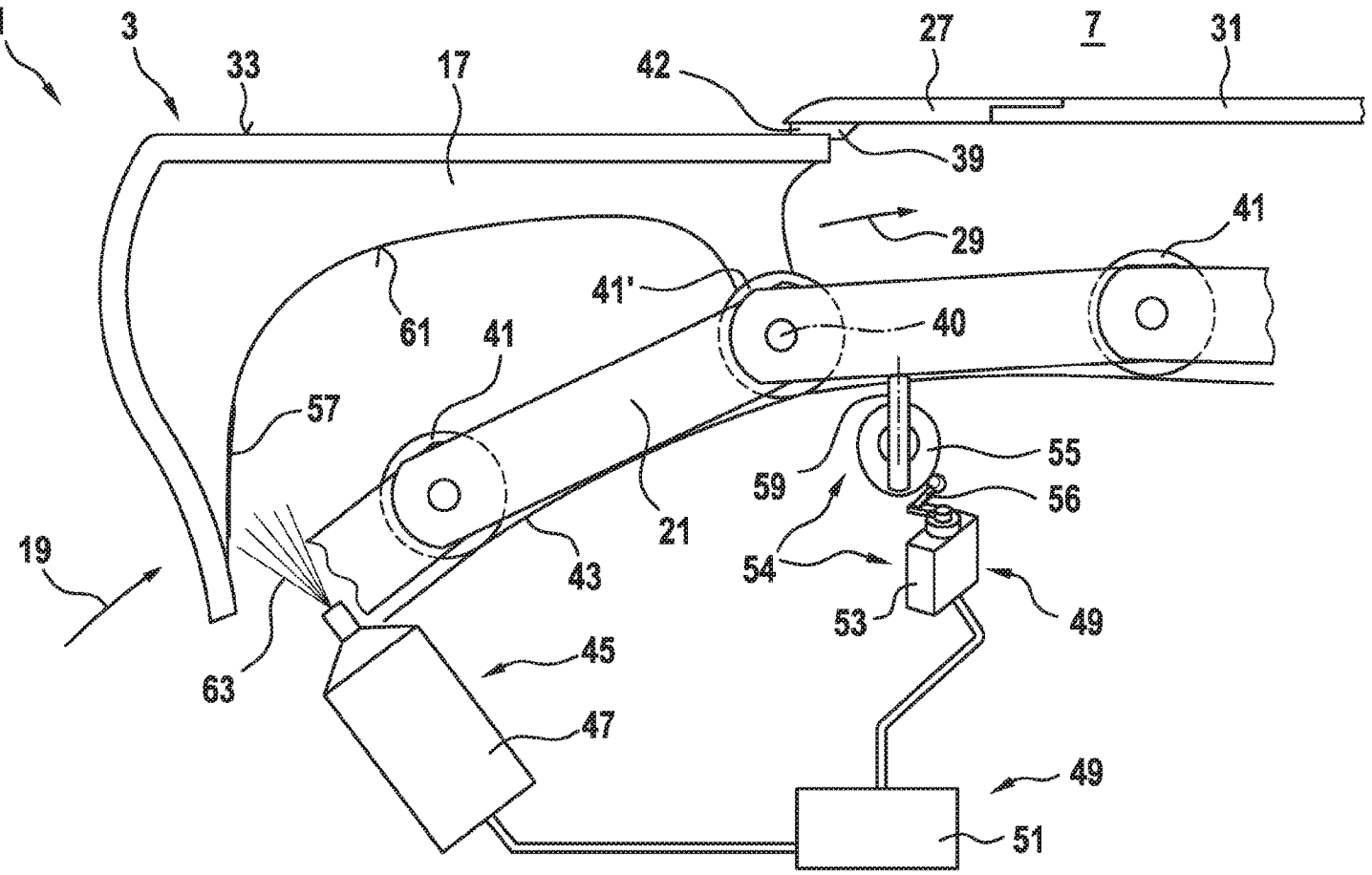
FIG. 3 is a sectional view through an end region of an escalator according to an embodiment of the present disclosure.

FIG. 3 shows a section of an escalator 3 near the upper access region 7. For reasons of clarity, only one individual step unit 17 is shown, which moves below the comb plate 27 in the direction of travel 19 by means of the conveyor chain 21. The step unit 17 is, near its front end, connected to the conveyor chain 21 via a pin 40. The conveyor chain 21 runs along a guide rail 43 via guide rollers 41.

If all the components of the passenger transport system 1 function correctly. i.e., none of the components deviate from the predefined state, for example due to damage or wear, the step units 17 move during normal operation along the predefined movement path 29, pulled by the conveyor chain 21 and guided by the guide rollers 41 running on the guide rail 43 and optionally by additional guide rollers or guide slide elements such as idling rollers (not shown). When approaching the upper access region 7, the step units 17 move below the comb plate 27 at a predetermined spacing of 1.5 mm, for example, i.e., are spaced apart by a gap 42. Such a small spacing ensures that the step unit 17 does not collide with the comb plate 27. It can also prevent objects or even body parts of passengers from getting caught in an excessive gap 42.

However, if there are deviations from a predefined state in the case of one or more components, such as heavy use of individual guide rollers 41', or if a guide roller 41 breaks, or if a shaft 40 breaks, or if the guide rail 43 is deformed, or similar, this can lead to deviations from the predefined movement path 29 when the steps 17 move.

For example, the diameter of an individual guide roller 41' may be reduced due to locally excessive use or wear or increased due to accumulation of dirt such that the step unit 17 connected to said guide roller via the pin 40 is no longer moved along the predefined movement path 29, but instead slightly lower or higher below the comb plate 27.

In particular, if the step unit 17 is raised higher. i.e., the gap 42 is reduced, this may result in danger of a collision with the comb plate 27. However, even if the front end of the step unit 17 were to be moved lower and therefore with a greater gap 42 below the comb plate 27 due to a reduced guide roller 41', there may be a risk of collision, as even in this case, the step unit 17 is no longer correctly guided along the predefined movement path 29, but instead may have a specific backlash and therefore, in the case of correspondingly unfavorable load from a passenger, the front end of the step unit 17 may tilt upwards and then collide with the comb plate 27.

In order to minimize such a risk of collision, a monitoring device 49 is provided for the passenger transport system 1. This monitoring device 49 is designed to be able to determine the actual position of a currently monitored step unit 17, in order to thereby be able to detect a deviation of the actual position from the predefined movement path 29.

If deviations are detected that are greater than a predetermined allowable tolerance value, the monitoring device 49 assumes that there is an increased risk of collision between the currently monitored step unit 17 and the comb plate 27. The monitoring device 49 can then take appropriate measures. For example, operation of the passenger transport system 1 can be adjusted or at least modified, for example decelerated. Additionally or alternatively, a warning signal may be transmitted to a central maintenance office and/or to the user of a passenger transport system 1.

In order to make it easier for maintenance personnel to identify a worn or damaged step unit 17, which is therefore in danger of collision, a marking device 45 is also provided for the passenger transport system 1. Upon being activated, this marking device 45 is designed to provide the currently monitored step unit 17 and/or one or more step units 17 that has a fixed locational relationship with this currently monitored step unit 17 with a marking (57). The marking 57 should preferably be visually perceptible, such that it can be detected by maintenance personnel easily and without additional tools.

In the embodiment shown in FIG. 3, the monitoring device 49 is equipped with a mechanically actuated position detector 54. The position detector 54 comprises a switch 53 of which the actuating arm 56 rests against a switch cam 55. The switch cam 55 rests in turn on the conveyor chain 21 via a sensing device 59. The monitoring device 49 or the switch 53 thereof is activated as soon as the conveyor chain 21 deviates excessively from its normal direction of movement. As the conveyor chain 21 is rigidly connected to each step unit 17 via the pins 40, the position of a currently monitored step unit 17 can be indirectly monitored in this way by monitoring the current position of the conveyor chain 21.

As soon as an intolerable deviation of the step unit 17 from the predefined movement path 29 is detected by the monitoring device 49 in this way, said monitoring device passes an activation signal on to the marking device 45 via the control means 51. The marking device 45 activated in this way therefore applies the marking 57 to the lower face 61 of the step unit 17 or to one of the lateral flanks of the step unit 17.

In the example shown, the marking device 45 is designed as a paint spray device 47. In this case, the paint spray device 47 is designed and arranged such that upon being activated, it can spray a jet of paint 63 towards the lower face 61 of the step unit 17. The paint spray device 47 itself does not touch the step unit 17 in this case, i.e. the marking 57 can be applied contactlessly.

However, the individual step units 17 may already comprise a clearly distinguishable marking 57 due to the production process. A marking 57 of this kind may be a serial production number, a barcode, an integrated RFID tag or the like, for example. This can be used by the marking device 45 in that the device does not mark the corresponding step unit 17 actively, for example by means of a spot of paint, but passively, by detecting and storing the uniquely identifiable marking 57. Accordingly, the marking device 45 may be designed to detect and identify an existing marking 57 that can be uniquely assigned to each step unit 17. For this purpose, the marking device 45 must comprise a detection device such as a camera, an RFID reading device and the like.

Figure 4:
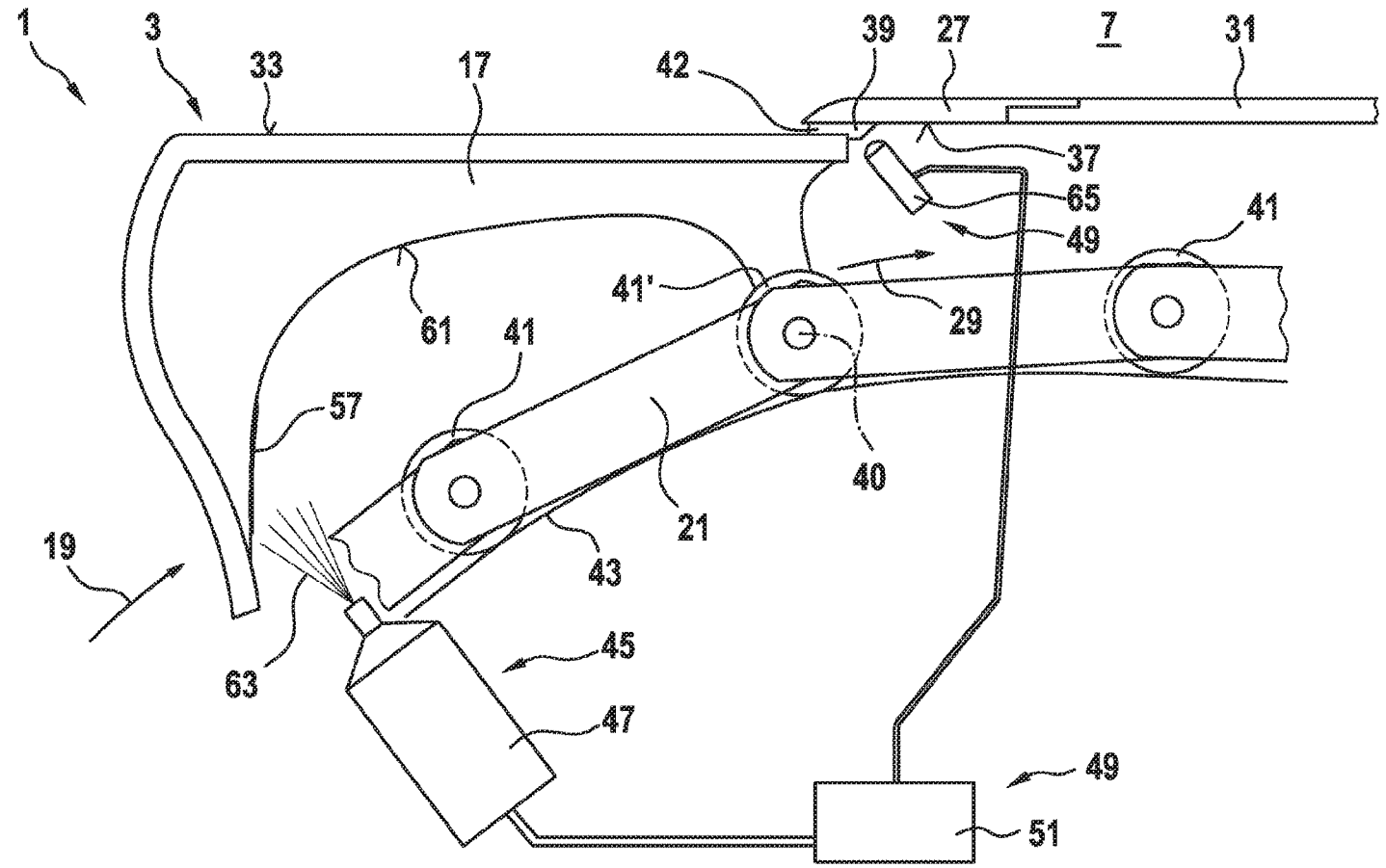
FIG. 4 is a sectional view through an end region of an escalator according to a further embodiment of the present disclosure.

Whereas in the embodiment shown in FIG. 3, the actual position of a currently monitored step unit 17 is monitored by a monitoring device 49 having a mechanically actuated position sensor 54, it is proposed, with reference to the embodiment shown in FIG. 4, to monitor this position contactlessly and preferably using an optically operating position detector 65.

The position detector 65 may monitor the gap 42 between the upper face 33 of the step unit 17 and the lower face 37 of the comb plate 27, for example. For this purpose, the position detector 65 may be designed in the form of a single-stage or multi-stage light barrier. As soon as the gap 42 changes its size, i.e. is narrowed or widened, this can be taken as evidence for an increased risk of collision, as a result of which the marking device 45 can be reactivated by the control means 51 connected to the position detector 65.

The position detector 65 may be arranged at a hole in one of the skirting panel 13 (see FIG. 1), for example, and monitor the gap 42 or alternatively another region of the step unit 17 through said hole. If the above-described unique marking 57 of the step unit 17 is arranged in the detection region of the position detector 65, said detector can also be used as a device for detecting the uniquely distinguishable, existing marking 57.

As an additional feature, the passenger transport system 1 may also be equipped with a guide device 67 (see FIG. 2). The guide device 67 may be designed and arranged to guide the step units 17 at a sufficient spacing from the comb plate 27 whilst they are being moved. In this case, the guide device 67 does not necessarily need to guide step units 17 running past said device. If a step unit 17 moves correctly along the predefined movement path 29, said unit does not need to be guided by the guide unit 67. Accordingly, the guide device 67 can remain passive in this case. However, if a step unit 17 is unallowably far from the predefined movement path 29, and therefore there is a risk of collision with the comb plate 27, the guide device 67 can guide the corresponding step unit 17 suitably such that a collision of this kind is prevented.

For example, the guide device 67 as shown in FIG. 2 may be arranged on a lateral edge of the comb plate 27. It can be provided there as a protruding and suitably geometrically formed metal plate 69 of which the lower face 71 is designed and arranged such that a region of the step unit 17 that comes too close to the comb plate 27 is pushed downwards and therefore away from the lower face 37 of the comb plate 27.

Optionally, functions of the monitoring device 49 may be combined with functions of the guide device 67. For example, a switch, for example in the form of a piezo element, may be provided on the lower face 71 of the guide device 67, which switch can be actuated by a step unit 17 that deviates from the predefined movement path 29, the marking device 45 being activated as a result.

In the case of the passenger transport system 1 proposed here or a passenger transport system retrofitted within the context of modernizing, collisions between a step unit and the comb plate can be prevented with the monitoring device and the marking device, and step units at risk of a collision can be quickly and easily detected by maintenance personnel using the marking applied to the units by the marking device.

Finally, it should be noted that terms such as "comprising," "having," etc., do not preclude other elements or steps and terms such as "a/an" or "one" do not preclude a plurality. Furthermore, it should be noted that features or steps that have been described with reference to one of the embodiments above can also be used in combination with other features or steps of other embodiments described above. Reference signs in the claims should not be considered limiting.

The invention claimed is:

1. A passenger transport system, comprising:

multiple step units configured to be moved one behind the other continuously along a predefined movement path during normal operation;

a comb plate arranged at a fixed position relative to the predefined movement path; and a monitoring device configured to monitor an actual position of a currently monitored step unit relative to the predefined movement path and to detect a deviation of the actual position from the predefined movement path by more than an allowable tolerance value and activate a marking device in response thereto;

wherein the marking device;

upon being activated, is configured to provide the currently monitored step unit and/or a step unit spatially correlating to the currently monitored step unit in a defined manner with a marking.

2. The passenger transport system according to claim 1, wherein the marking device is configured to form the marking as a visually perceptible marking.

3. The passenger transport system according to claim 1, wherein the marking device is configured to apply the marking to the step unit contactlessly.

4. The passenger transport system according to claim 1, wherein the marking device comprises a paint spray device.

5. The passenger transport system according to claim 1, wherein the marking device is configured and arranged to provide the step unit with the marking on a lower face and/or a side face of the step unit.

6. The passenger transport system according claim 1, wherein the marking device configured to detect and identify an available marking that can be uniquely assigned to each step unit.

7. The passenger transport system according claim 1, wherein the monitoring device comprises a mechanically operable position detector that is configured and arranged to be mechanically operated if there is a deviation of the actual position of the currently monitored step unit from the predefined movement path by more than an allowable tolerance value.

8. The passenger transport system according to claim 1, further comprising a conveyor chain, wherein each step unit is mechanically connected to the conveyor chain at a defined position and is moved by the conveyor chain, and wherein the monitoring device is configured to indirectly monitor the position of the currently monitored step unit by monitoring a current position of the conveyor chain.

9. The passenger transport system according to claim 1, wherein the marking device is configured to monitor the actual position of the currently monitored step unit contactlessly.

10. The passenger transport system according claim 1, wherein the marking device is configured to monitor the actual position of the currently monitored step unit optically.

11. The passenger transport system according to claim 1, wherein the monitoring device comprises an optically operating position detector that is configured and arranged to be operated when there is a deviation of the actual position of the currently monitored step unit from the predefined movement path by more than an allowable tolerance value.

12. The passenger transport system according to claim 1, wherein the marking device is configured and arranged to monitor a position of a step surface of the currently monitored step unit that faces upwards.

13. The passenger transport system according to claim 1, further comprising a guide device that is designed and arranged to guide the step units at a sufficient spacing from the comb plate whilst they are being moved.

14. The passenger transport system according to claim 1, wherein the monitoring unit is further designed to cause the passenger transport system to cease its normal operation and/or to transmit a warning signal upon activation of the marking device.

15. The passenger transport system according to claim 1, wherein the tolerance value is selected such that a spacing between a surface of a profile of the comb plate that faces downwards and a surface of the currently monitored step unit that is opposite said surface and faces upwards is between 0.3 mm and 3 mm.

16. A method for modernizing an existing passenger transport system, wherein the passenger transport system has multiple step units and a comb plate, wherein the step units are to be moved one behind the other continuously along a predefined movement path during normal operation, and the comb plate is arranged at a fixed position relative to the predefined movement path, the method comprising:

retrofitting the passenger transport system with a monitoring device and a marking device;

the monitoring device configured to monitor an actual position of a currently monitored step unit relative to the predefined movement path and to detect a deviation of the actual position from the predefined movement path by more than an allowable tolerance value and activate the marking device in response thereto;

wherein upon being activated, the marking device is configured to provide the currently monitored step unit and/or a step unit spatially correlating to the currently monitored step unit in a defined manner with a marking.

17. The passenger transport system according to claim 1, wherein the tolerance value is selected such that a spacing between a surface of a profile of the comb plate that faces downwards and a surface of the currently monitored step unit that is opposite said surface and faces upwards is between 1 mm and 1.6 mm.

* * * * *